US008668511B2

(12) United States Patent
Guo

(10) Patent No.: US 8,668,511 B2
(45) Date of Patent: Mar. 11, 2014

(54) HERMAPHRODITIC ELECTRICAL CONNECTOR

(75) Inventor: Jing-Jie Guo, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 338 days.

(21) Appl. No.: 13/236,075

(22) Filed: Sep. 19, 2011

(65) Prior Publication Data

US 2012/0088386 A1 Apr. 12, 2012

(30) Foreign Application Priority Data

Oct. 8, 2010 (CN) ..... 2010 2 0551010

(51) Int. Cl.
*H01R 13/28* (2006.01)
*H01R 25/00* (2006.01)

(52) U.S. Cl.
USPC ..... 439/291; 439/295

(58) Field of Classification Search
USPC ..... 439/284, 290, 291, 295, 626, 660
See application file for complete search history.

(56) References Cited

U.S. PATENT DOCUMENTS

| | | | | |
|---|---|---|---|---|
| 3,461,258 | A * | 8/1969 | Shlesinger, Jr. | 200/253.1 |
| 3,827,007 | A * | 7/1974 | Fairbairn et al. | 439/293 |
| 5,498,167 | A | 3/1996 | Seto et al. | |
| 5,520,545 | A * | 5/1996 | Sipe | 439/65 |
| 2007/0010108 | A1 * | 1/2007 | Yeen Soh et al. | 439/74 |
| 2009/0081903 | A1 * | 3/2009 | Zhang et al. | 439/626 |

* cited by examiner

*Primary Examiner* — Felix O Figueroa
(74) *Attorney, Agent, or Firm* — Ming Chieh Chang; Wei Te Chung

(57) ABSTRACT

A hermaphroditic electrical connector assembly comprises a first connector (10*a*) and an identical second connector (10) to mate with each other, each connector comprising: an insulating housing (20) having a base portion (21), a pair of fixing arms (24) molded two side of the base portion and locating two ends of the diagonal of the base portion separately. and several terminal slots (22) on the base portion; and a number of terminals (5) retained in the terminal slots of the insulating housing; the fixing arms of the first connector engaging with same side fixing arms of the second connector.

10 Claims, 7 Drawing Sheets

HERMAPHRODITIC ELECTRICAL CONNECTOR

FIELD OF THE INVENTION

The present invention generally relates to an electrical connector assembly, and more particularly to a board-to-board connector assembly.

DESCRIPTION OF RELATED ART

Nowadays, connectors play an important role to transmit signals between different electrical devices. Usually, a connector assembly includes a first connector and a second connector for matching with each other, and each connector has different standards and different sizes. Company needs to design different connectors and two different matching molds, and each connector needs different components (such as terminals) involving different suppliers. Therefore, costs of design and manufacture are increased.

U.S. Pat. No. 5,498,167 issued on Mar. 12, 1996 discloses a hermaphroditic board-to-board connector assembly. The connector assembly includes a first connector to mate with an identical second connector, and each connector includes a housing and at least one pair of male and female terminals held in the housing to mate with corresponding second pair of terminals of the second connector. Since the male terminal is different from the matching female terminal, two kinds of different terminals are needed. Besides, the first connector may not be inserted into the second connector accurately and be secured with each other tightly.

Hence, an improved electrical connector assembly is highly desired to overcome the aforementioned problems.

SUMMARY OF THE INVENTION

Accordingly, an object of the present invention is to provide a connector assembly with two identical connectors to mate with each other.

In order to achieve the object set forth, a hermaphroditic electrical connector assembly comprises a first connector and an identical second connector to mate with each other, each connector comprising: an insulating housing having a base portion, a pair of fixing arms molded on two sides of the base portion and located at two ends of the diagonal of the base portion separately, and several terminal slots slotting on the base portion; and a plurality of terminals retained in the terminal slots of the insulating housing; the fixing arms of the first connector engaging with the same side fixing arms of the second connector.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
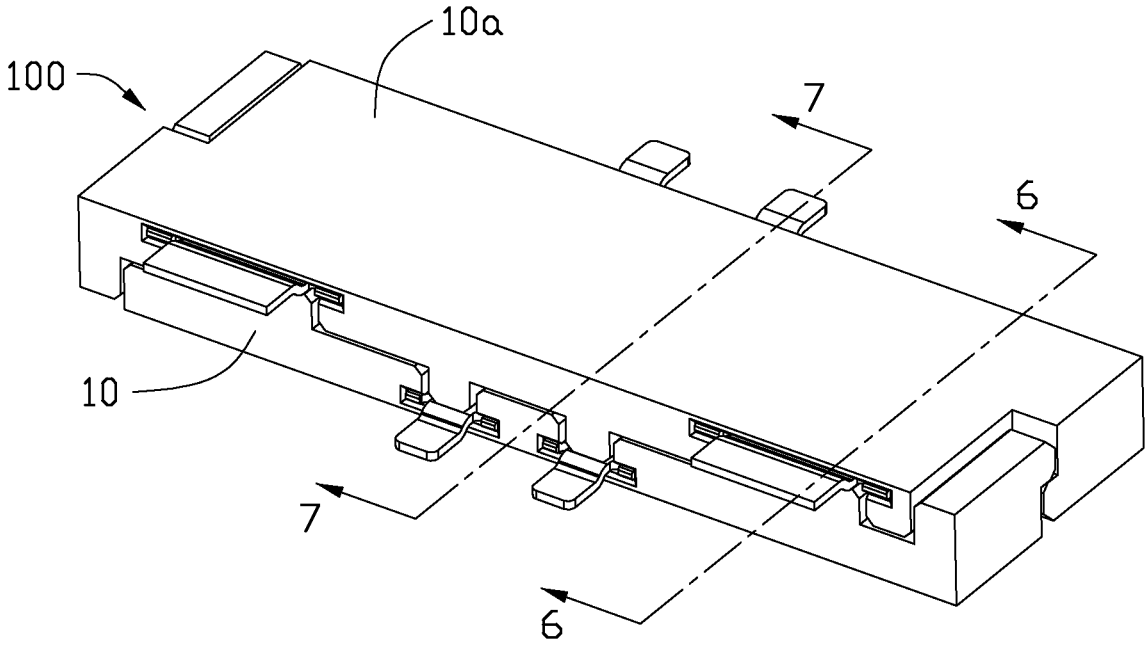
FIG. 1 is an assembled, perspective view of the connector assembly.
Figure 2:
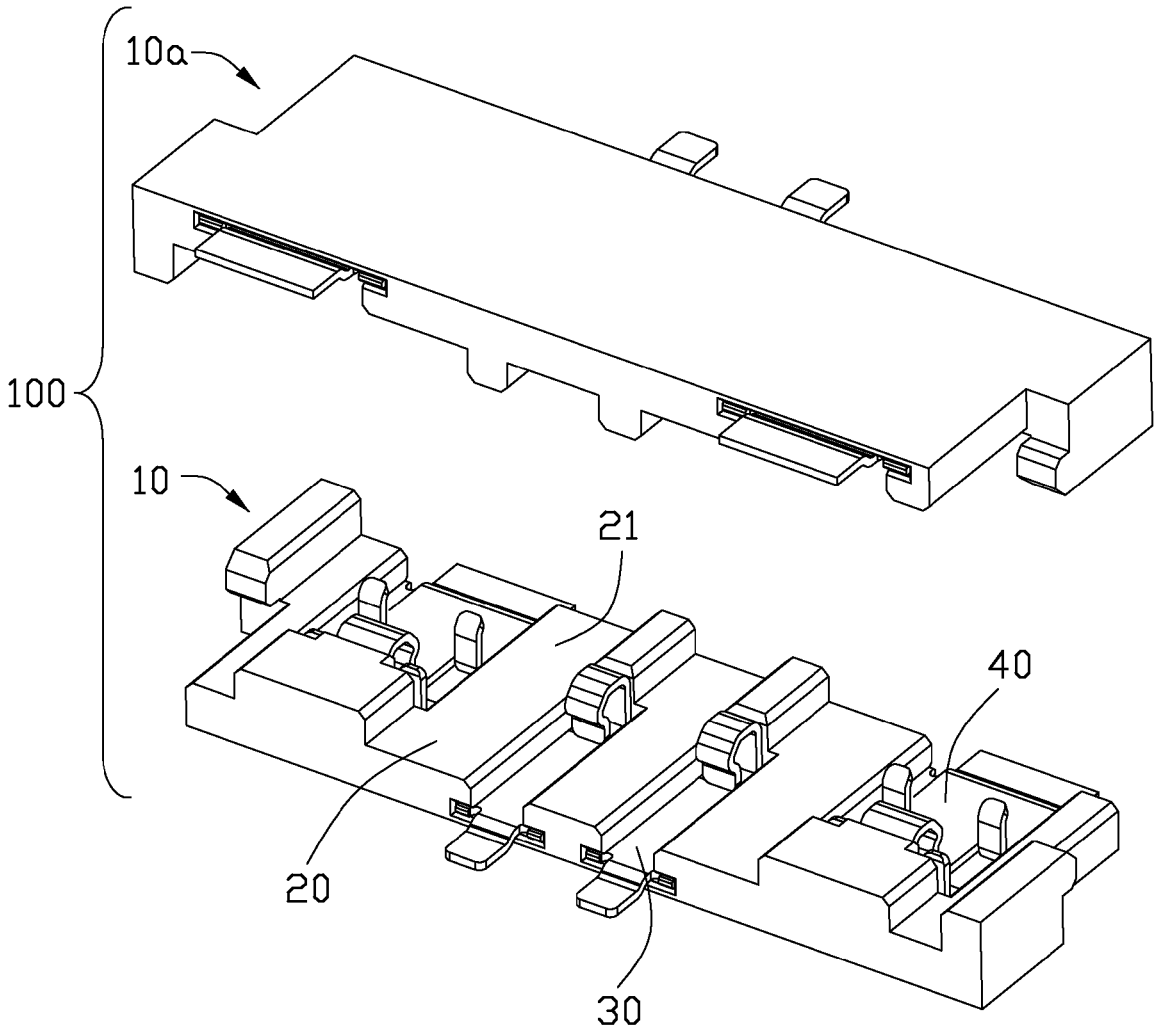
FIG. 2 is a partially exploded view of the connector assembly.

Referring to FIGS. 1-2, a hermaphroditic connector assembly 100 comprises a first connector 10 and a second connector 10*a*. The first and second connectors 10,10*a* have identical structure.

Figure 3:
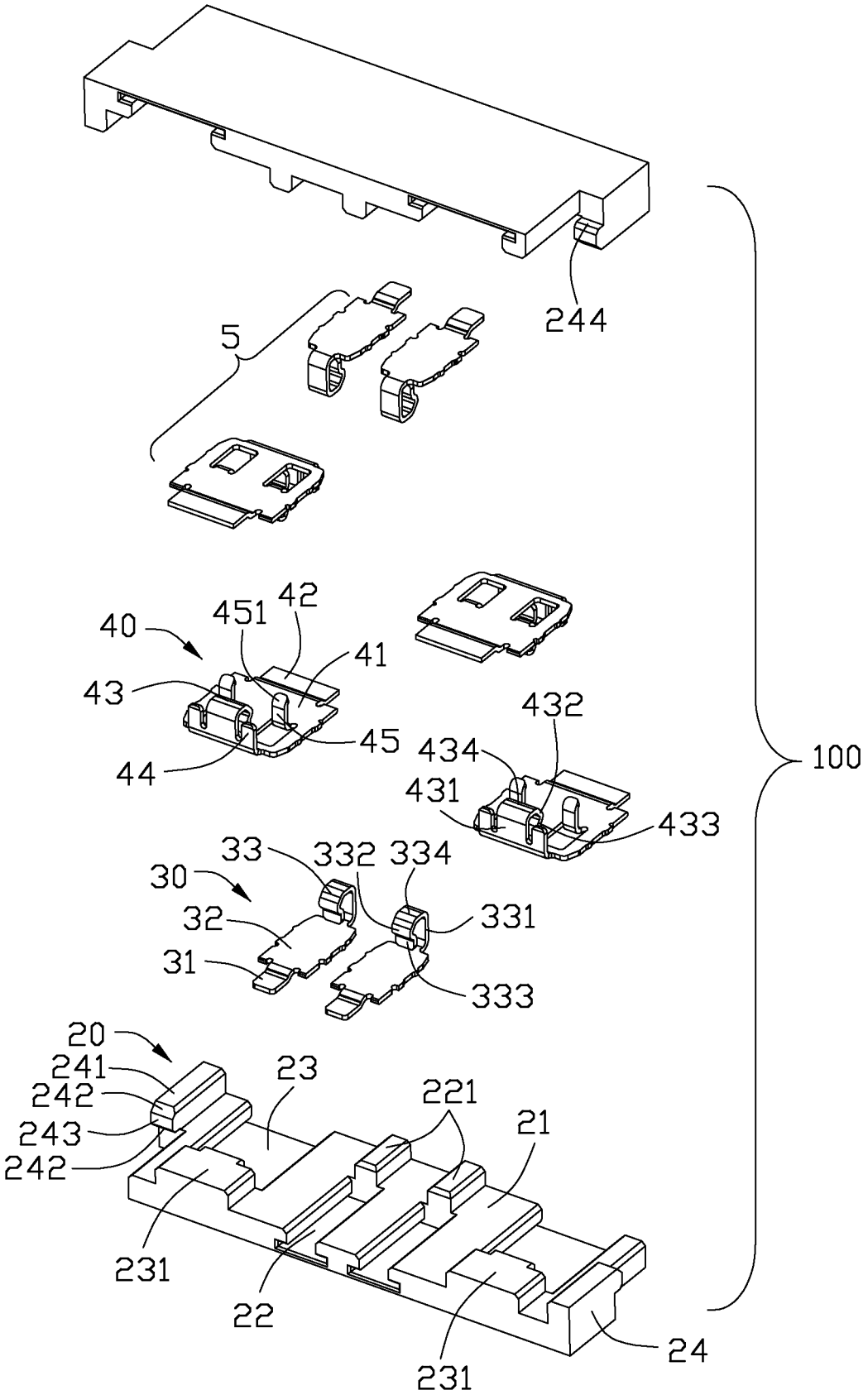
FIG. 3 is an exploded, perspective view of the connector assembly.
Figure 4:
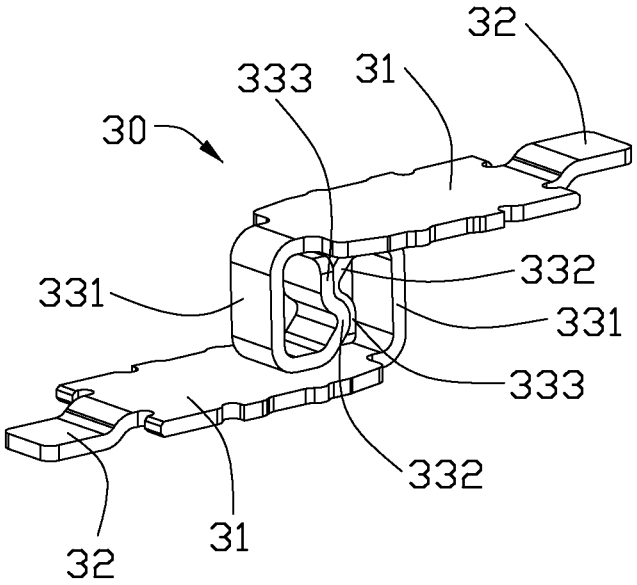
FIG. 4 is a matched, perspective view of the signal terminals.
Figure 5:
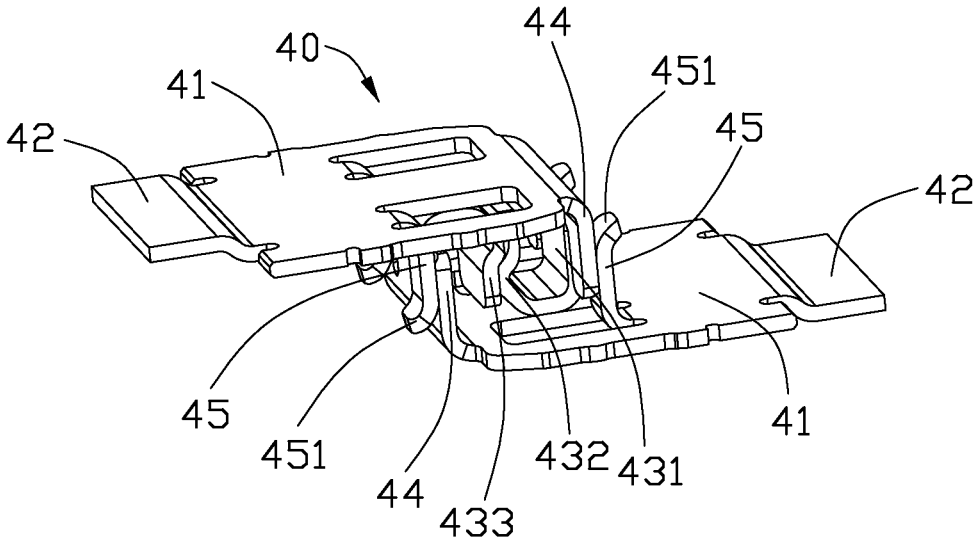
FIG. 5 is a matched, perspective view of the power terminals.
Figure 6:
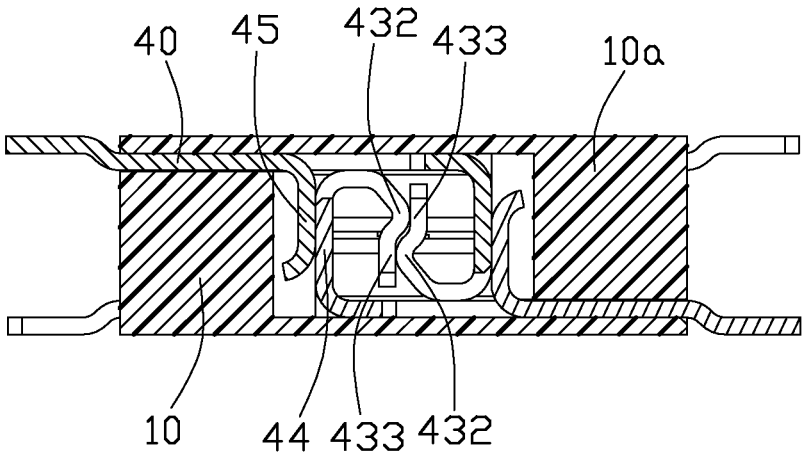
FIG. 6 is a cross-section view of FIG. 1 taken along line 6-6.
Figure 7:
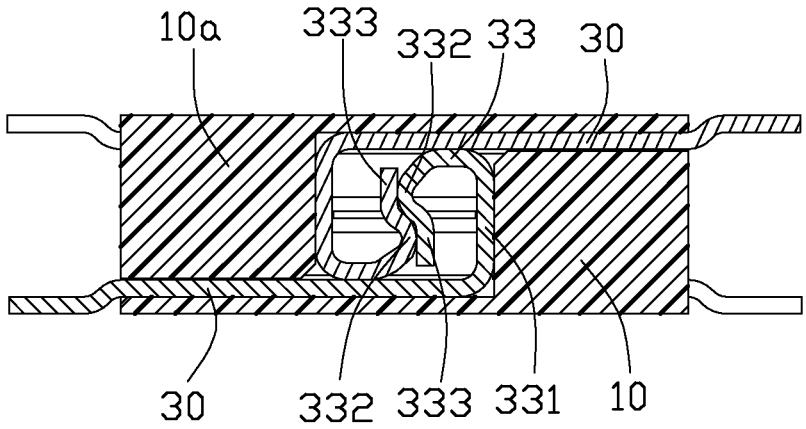
FIG. 7 is a cross-section view of FIG. 1 taken along line 7-7.

Referring to FIGS. 2-3, each connector 10, 10*a* comprises a rectangular insulating housing 20 and a plurality of terminals 5 mounted on the insulating housing 20. The insulating housing 20 includes a base portion 21 and a pair of fixing arms 24 integrally molded with the base portion 21 and located at two sides of the base portion 21. The base portion 21 includes a plurality of terminal slots divided into a pair of signal terminal slots 22 and a pair of power terminal slots 23. The signal terminal slots 22 are located at the middle of the base portion 21 while the power terminal slots 23 are located at two sides of the signal terminal slots 22, respectively. The signal terminal slots 22 have openings in one direction and the power terminal slots 23 have openings in an opposite direction. Each signal terminal slot 22 has a block 221 distal from opening direction thereof and each power terminal slot 23 has a block 231 distal from opening direction thereof. The fixing arms 24 extend partly from two sides of the base portion 21 and are arranged in two ends of the diagonal direction of the base portion 21. The fixing arm 24 extends upwardly and forms a bump 241 higher than the exterior of the base portion 21. Interior ends of the two bumps 241 extend oppositely toward the middle level of the base portion 21 and form tabs 243 and keeping rooms 244 below the tabs 243. A pair of upper and lower inclined guiding surfaces 242 are defined at the distal end of each tab 243.

The terminals 5 include signal terminals 30 and power terminals 40 assembled in the signal terminal slots 22 and power terminal slots 23, respectively. The signal terminal 30 includes a fastening portion 32, a soldering portion 31, and a contact arm 33 extending upwardly from an edge of the fastening portion 32. The contact arm 33 includes a vertical arm 331 extending from the fastening portion 32, a top portion 334 bending and sidewardly extending from a top end of the vertical arm 331, an arcuate portion 332 extending downwardly toward the fastening portion 32 from the end of the top portion 334, and a concavity 333 defined on the end of the arcuate portion 332.

The power terminal 40 includes a fastening portion 41, a soldering portion 42, and a contact arm 43 extending from an edge of the fastening portion 41. The contact arm 43 has a vertical arm 431, a top portion 434, an arcuate portion 432 and a concavity 433, which are the same as the contact arm 33 of the signal terminal 30. The power terminal 40 has a pair of second contact arms 44 and a pair of third contact arms 45 extending upwardly from two sides of the contact arm 43. The second arms 44 extend upward from a top edge of the fastening portion 41 and are located in a vertical plane which is defined by the vertical arm 431. The third contact arm 45 splits partly and extends upward from the middle of the fastening portion 41 and has an inclined plane 451 on the end thereof. The second contact arms 44 and the third contact arms 45 define two parallel straight lines.

Following will detail how the identical male and second connectors 10, 10*a* mate with each other and how to assemble the terminals 5 in the insulating housing 20. Referring to FIGS. 3-7, firstly, the signal terminals 30 and the power terminals 40 are assembled in the signal terminal slots 22 and the power terminal slots 23 of the insulating housing 20, respectively, along opposite directions. The contact arms 33, 43 of the signal terminals 30 and the power terminals 40 are exposed out of surface of the base portion 21 and lean against the blocks 221, 231. And then, the first connector 10*a* is inserted into the second connector 10 to mate with each other so that the signal terminals 30 of the first connector 10*a* mate with the identical signal terminals 30 of the second connector 10, and the power terminals 40 of the first connector 10*a* mate with the identical power terminals 40 of the second connector 10. The arcuate portion 332 of the signal terminal 30 of the first connector 10*a* is retained in the concavity 333 of the corresponding signal terminal 30 of the second connector 10 to integrate the two mating signal terminals 30 together. The top portion 334 of the first connector 10*a* connects with the surface of the fastening portion 31. The contact arm 43 of the power terminal 40 of the first connector 10*a* mates with the contact arm 43 of the second connector 10 in a same way as the mating means of the signal terminal 30. The second contact arm 44 of the first connector 10*a* (or second connector 10) contacts with the third contact arm 45 of the second connector 10 (or first connector 10*a*) via the inclined plane 451 of end of the third contact arm 45. In this way, several contacting points are made between the identical terminals 5 to meet the needs of high current. The fixing arm 24 of the first connector 10*a* (or second connector 10) engages or locks with other fixing arm 24 of the second connector 10 (or first connector 10*a*) by one side of the base portion 21 separately. The tabs 243 of the first connector 10*a* (or second connector 10) are received in and fix with the corresponding keeping rooms 244 of the second connector 10 (or first connector 10*a*) to integrate the male and second connectors 10,10*a* together.

The set of first terminals 21 have four contact members arranged in a row along the transversal direction. Each first terminal 21 substantially includes a planar retention portion 212 supported by a bottom surface of the recess 113, a mating portion 211 raised upwardly and extending forwardly from the retention portion 212 and received in the corresponding first terminal groove 127, and a tail portion 213 extending rearward from the retention portion 212.

The present invention reduces costs in design and manufacturing processes and reduces the inventory stocks by the hermaphroditic connector assembly 100 and identical mating terminals 5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A hermaphroditic electrical connector assembly comprising a first connector and an identical second connector to mate with each other, each connector comprising:

an insulating housing having a base portion and a plurality of terminal slots slotting on the base portion; and a plurality of terminals retained in the terminal slots of the insulating housing, each terminal comprising a fastening portion, a soldering portion and a contact arm extending from two opposite ends of the fastening portion, the contact arm comprising a vertical arm, an arcuate portion bending downwardly from the vertical arm, and a concavity defined at the end of the arcuate portion; and wherein the arcuate portion of the first connector is retained in the concavity of the second connector and the concavity of the first connector receives the arcuate portion of the second connector wherein a top portion is defined between the vertical arm and the arcuate portion to contact with the surface of the fastening portion; wherein there are two pairs of second and third contact arms surrounding the contact arm of the terminal.

2. The electrical connector assembly as recited in claim 1, wherein the pair of second contact arms extend from the edge of the fastening portion and define a plane with the vertical arm, the pair of third contact arms splitting from the fastening portion on front of the contact arm of the terminal.

3. The electrical connector assembly as recited in claim 2, wherein an inclined plane is defined on an end of the third contact arm.

4. The electrical connector assembly as recited in claim 2, wherein the second contact arms together with the corresponding third contact arms define two parallel lines.

5. The electrical connector assembly as recited in claim 1, wherein the terminal slots comprise a plurality of signal terminal slots and a plurality of power terminal slots located at two sides of the signal terminal slots, opening directions of the signal terminal slots being reversed to that of the signal terminal slots.

6. The electrical connector assembly as recited in claim 5, wherein there are a plurality of blocks extending upward from the base portion adjacent to the rear end of the terminal slots.

7. The electrical connector assembly as recited in claim 6, wherein the vertical arm of contact arm touches against the block in rear of the terminal slot.

8. The electrical connector assembly as recited in claim 1, wherein there are a pair of fixing arms molded at two sides of the base portion.

9. An electrical connector for mating with an identical connector, comprising:

an insulative elongated housing extending in a lengthwise direction and defining a mating direction perpendicular to said lengthwise direction; and a first group of contacts and a second group of contacts assembled into the housing parallel to a transverse direction perpendicular to the lengthwise direction and said mating direction; wherein each of the first group of contacts defines a first contacting section which cooperates with the housing for sandwiching the counterpart first contacting section of the identical mating connector on one hand and is sandwiched by the counterpart first contacting section and the counterpart housing of the identical mating connector for assuring reliable and stable transverse connection between the first contacting section of the connector and the counterpart first contacting section of the identical mating connector, while each of the second group of contacts defines a second contacting section having opposite first part and second part spaced from each other in the transverse direction for having the first part engage the corresponding first part of the counterpart second contacting section in the transverse direction while having the second part engage the corresponding second part of the counterpart second contacting sections in an opposite transverse direction for assuring reliable and stable transverse connection between the second contacting section of the connector and the counterpart second contacting section of the identical mating connector wherein the first part includes a pair of spring arms spaced from each other in the transverse direction.

10. The electrical connector as claimed in claim 9, wherein the first part and the second part are further spaced from each other in the lengthwise direction.

* * * * *